US011055987B2

(12) United States Patent
Takemura

(10) Patent No.: US 11,055,987 B2
(45) Date of Patent: Jul. 6, 2021

(54) ANIMATED INCOMING TRAFFIC SIGN

(71) Applicant: Norio Takemura, Ottawa (CA)

(72) Inventor: Norio Takemura, Ottawa (CA)

(73) Assignee: NORTAK SOFTWARE LTD.

( * ) Notice: Subject to any disclaimer, the term of this patent is extended or adjusted under 35 U.S.C. 154(b) by 0 days.

(21) Appl. No.: 16/481,232

(22) PCT Filed: Jan. 25, 2018

(86) PCT No.: PCT/CA2018/050085
§ 371 (c)(1),
(2) Date: Jul. 26, 2019

(87) PCT Pub. No.: WO2018/137031
PCT Pub. Date: Aug. 2, 2018

(65) Prior Publication Data
US 2019/0371164 A1 Dec. 5, 2019

Related U.S. Application Data

(60) Provisional application No. 62/450,689, filed on Jan. 26, 2017.

(51) Int. Cl.
*G08G 1/01* (2006.01)
*G08G 1/056* (2006.01)
*G08G 1/09* (2006.01)

(52) U.S. Cl.
CPC ..... *G08G 1/0116* (2013.01); *G08G 1/056* (2013.01); *G08G 1/09* (2013.01)

(58) Field of Classification Search
CPC .... G08G 1/0116; G08G 1/0129; G08G 1/056; G08G 1/09; G08G 1/095
See application file for complete search history.

(56) References Cited

U.S. PATENT DOCUMENTS 3,720,913 A * 3/1973 Bradford ..... G08G 1/0962 340/933
5,339,081 A 8/1994 Jefferis et al.
5,572,202 A 11/1996 Regel et al.
5,654,705 A 8/1997 Houten et al.
7,443,315 B2 10/2008 Lo
7,821,422 B2 10/2010 Hutchison et al.
(Continued)

FOREIGN PATENT DOCUMENTS

CA 630839 A 11/1961
GB 1286251 A 8/1972
(Continued)

OTHER PUBLICATIONS

Patent Cooperation Treaty (PCT), International Search Report and Written Opinion for Application PCT/CA2018/050085 filed Jan. 25, 2018, dated Apr. 16, 2018, International Searching Authority, CA.

*Primary Examiner* — Omeed Alizada
(74) *Attorney, Agent, or Firm* — McDonald Hopkins LLC

(57) ABSTRACT

Systems and methods that provide indications that incoming traffic is present. A display deployed at an intersection is visible to traffic coming from one direction. The display is activated when a sensor senses traffic coming from another direction. The activated display provides a moving or animated display that shows the direction that traffic is coming from.

12 Claims, 8 Drawing Sheets

(56) References Cited

U.S. PATENT DOCUMENTS

| | | | | |
|---|---|---|---|---|
| 8,665,114 | B2 | 3/2014 | Cozens | |
| 2005/0151670 | A1 | 7/2005 | Johnson | |
| 2007/0085703 | A1 | 4/2007 | Clark et al. | |
| 2008/0094249 | A1 | 4/2008 | Pappas et al. | |
| 2008/0266136 | A1 | 10/2008 | Diba | |
| 2011/0298603 | A1 | 12/2011 | King et al. | |
| 2012/0179518 | A1 | 7/2012 | Jaipaul | |
| 2014/0118553 | A1* | 5/2014 | Diba | G08G 1/097 348/149 |
| 2016/0148507 | A1* | 5/2016 | Pittman | G06Q 30/0255 340/917 |
| 2016/0155334 | A1 | 6/2016 | Jansson et al. | |
| 2016/0292996 | A1 | 10/2016 | Kim et al. | |

FOREIGN PATENT DOCUMENTS

| | | | |
|---|---|---|---|
| GB | 1443701 | A | 7/1976 |
| GB | 2464096 | A | 4/2010 |
| GB | 2500203 | A | 9/2013 |
| GB | 2520934 | A | 6/2015 |
| GB | 2535320 | A | 8/2016 |
| WO | 2015143243 | A1 | 9/2015 |

* cited by examiner

ANIMATED INCOMING TRAFFIC SIGN

CROSS-REFERENCE TO RELATED APPLICATION

This application is a 35 U.S.C. 371 national stage filing of PCT Application No. PCT/CA2018/050085 filed on Jan. 25, 2018, entitled "ANIMATED INCOMING TRAFFIC SIGN," which claims priority to U.S. Provisional Patent Application No. 62/450,689, filed on Jan. 26, 2017, each of which are incorporated herein in their entirety by reference.

TECHNICAL FIELD

The present invention relates to traffic signs. More specifically, the present invention relates to a system for use in notifying about incoming traffic coming from another direction.

BACKGROUND

Since the invention of the automobile, traffic accidents have become a part of the price of the convenience of the automobile. Accidents may happen due to, among other things, driver inattentiveness, insufficient signage, and insufficient warnings about traffic conditions. One common location of traffic accidents, especially in the Third World, is the road intersection. Drivers coming from one direction are usually inattentive to traffic coming from another direction, especially in rural areas. This usually results in easily preventable accidents.

Some measures have been used to try and reduce the number of such accidents at road intersections. Signs urging caution have been used along with stop signs and even stop lights and other traffic aids. However, such signs are easily ignored or are unnoticed by motorists given the static nature of such signs. Stop lights, on the other hand, are also ignored, especially in rural areas where traffic might be sparse. If such stop lights are timer driven, a motorist might ignore the lights if their experience indicates that traffic is sparse. However, in the instances where incoming traffic is present, collisions may occur.

There is therefore a need for a solution that is not easily ignored by motorists and which can indicate to such motorists that caution in approaching the intersection should be taken.

SUMMARY

The present invention relates to traffic signs. More specifically, the present invention relates to systems and methods that provide indications that incoming traffic is present. A display deployed at an intersection is visible to traffic coming from one direction. The display is activated when a sensor senses traffic coming from another direction. The activated display provides a moving or animated display that shows the direction that traffic is coming from.

In a first aspect, the present invention provides a traffic notification system comprising:

at least one activatable display, said display being visible to first incoming traffic travelling from a first direction;

at least one sensor for sensing second incoming traffic travelling from a second direction;

wherein said first direction is different from said second direction;

said at least one display is activated when second incoming traffic is sensed by said at least one sensor;

when said at least one display is activated, said display provides a visual warning to said first incoming traffic that said second incoming traffic is present.

In a second aspect, the present invention provides a method for controlling a traffic notification system, the system having at least one activatable display and at least one sensor for sensing incoming traffic travelling from at least one specific direction, the method comprising:

a) ensuring that said at least one display is inactive and that said at least one sensor is active;

b) determining if said at least one sensor senses incoming traffic;

c) in the event said at least one sensor senses said incoming traffic, activating said at least one activatable display for at least a predetermined period of time;

d) in the event said at least one sensor does not sense incoming traffic, continuing a current state of said at least one activatable display; and e) repeating steps b)-d).

BRIEF DESCRIPTION OF THE DRAWINGS

The embodiments of the present invention will now be described by reference to the following figures, in which identical reference numerals in different figures indicate identical elements and in which.

DETAILED DESCRIPTION

Figure 1:
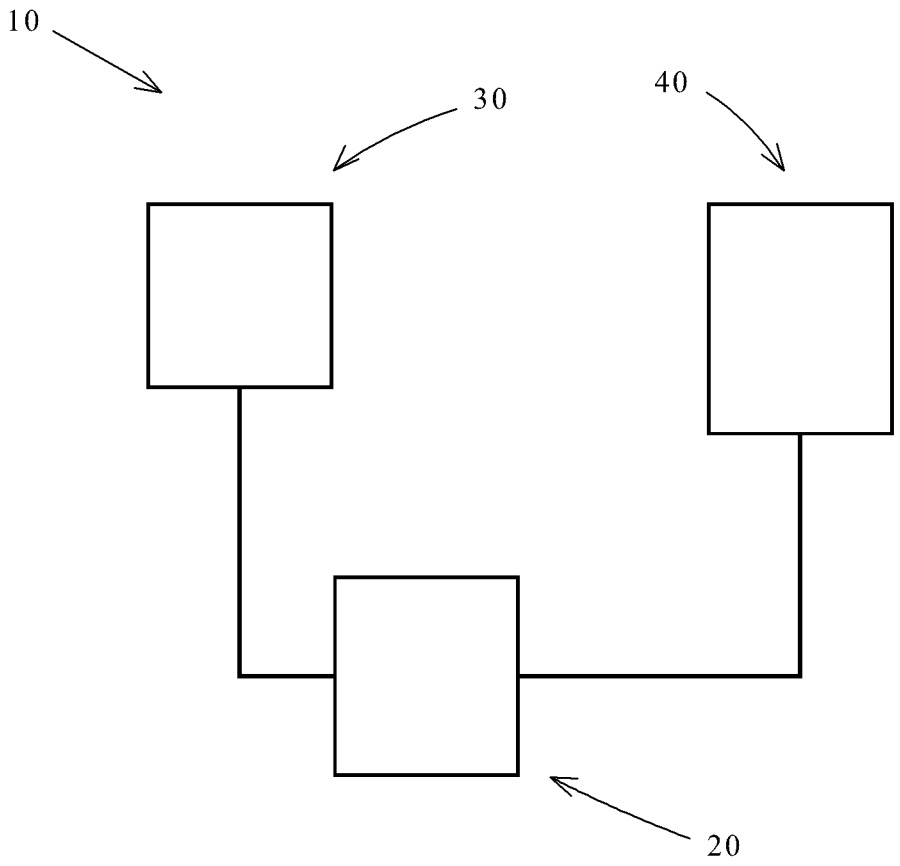
FIG. 1 is a block diagram of a system according to one aspect of the invention.

Referring to FIG. 1, a block diagram illustrating a system according to one aspect of the invention is presented. The system 10 has a main control module 20 coupled to a display 30 and to a sensor module 40. The sensor module 40 cooperatively functions with a sensor that detects incoming traffic. When incoming traffic, coming from a specific direction, is sensed by the sensor, a signal is transmitted to the main control module 20. When the main control module 20 receives this signal, the main control module 20 activates the display 30. When activated, the display 30 displays an indication of where the incoming traffic is coming from.

Figure 2:
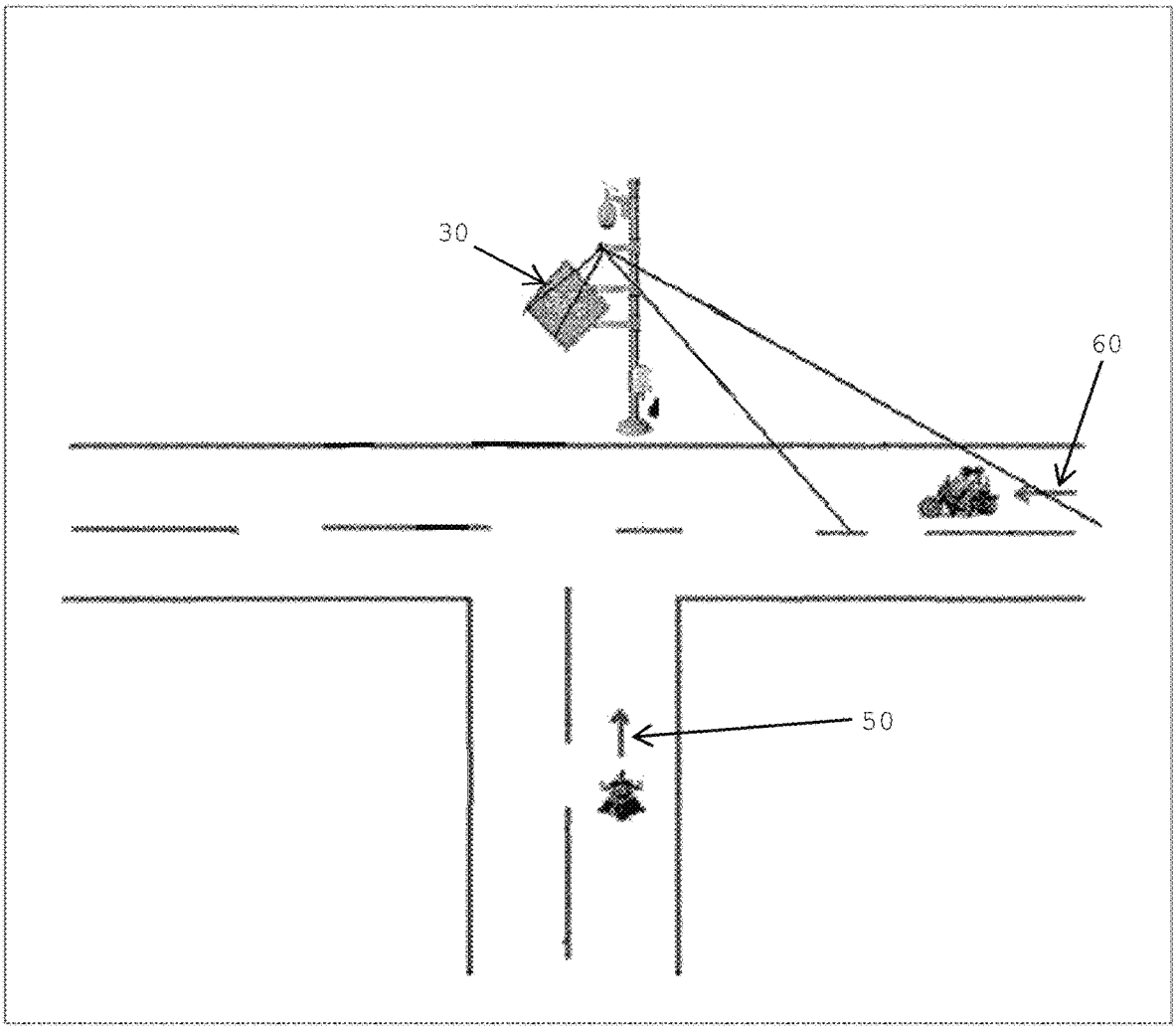
FIG. 2 is a diagram illustrating a T-intersection used to explain a functioning of one aspect of the invention.

To better explain the purpose and function of the system 10, FIG. 2 is provided. As can be seen, FIG. 2 illustrates a T-intersection with the display 30 being deployed at the intersection. As can be seen, the display 30 is visible to traffic coming from a direction 50. When in operation, the system 10 senses traffic coming from a direction 60. The two directions 50, 60 are, for this implementation, orthogonal to one another. Other implementations may, of course, be different with the two directions being at an angle other than 90 degrees to one another. From FIG. 2, it can be seen that the sensor detects traffic coming from direction 60 and, when that occurs, the system activates the display 30.

Figure 3:
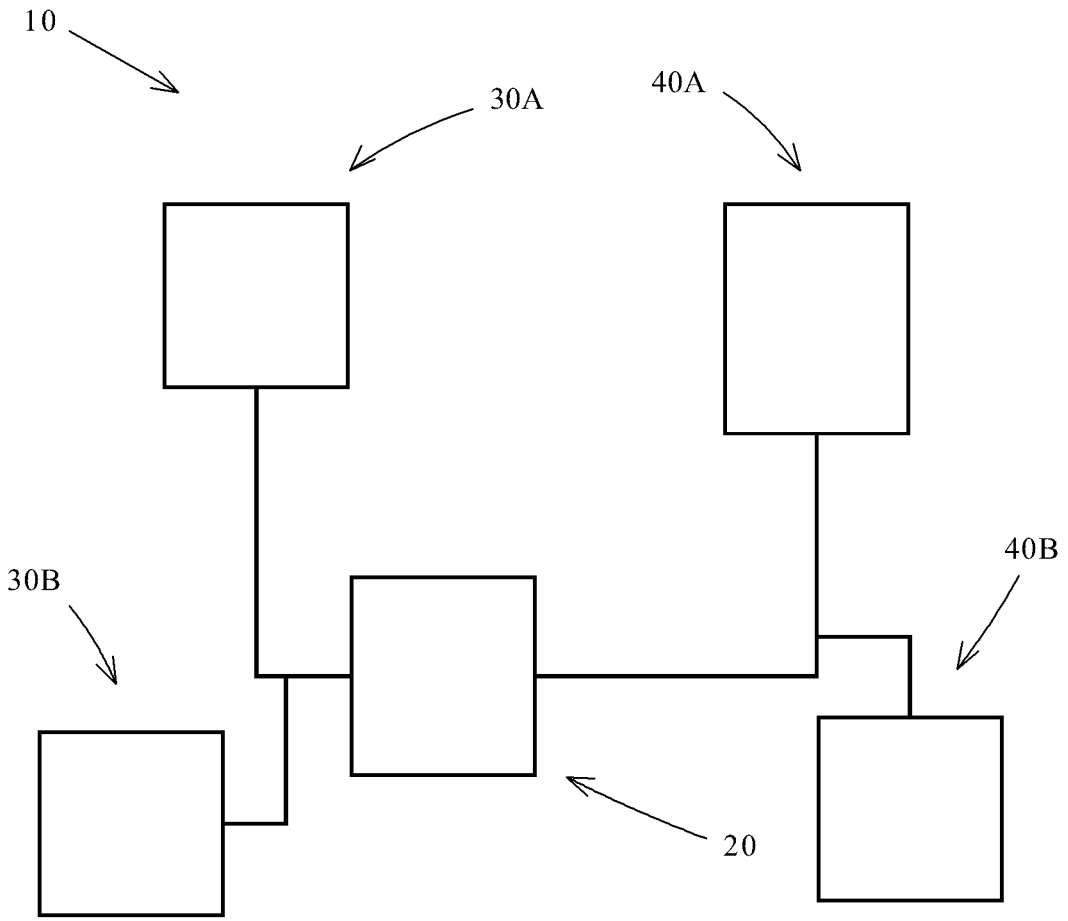
FIG. 3 is a block diagram of a variant of the system illustrated in FIG. 1.

Referring to FIG. 3, a block diagram of another implementation of the system 10 is illustrated. As can be seen, this implementation uses two displays 30A, 30B and two sensor modules 40A, 40B. For this implementation, the system 10 monitors two directions and, when traffic is approaching from those directions, the relevant display is activated. For such an implementation, one display corresponds to one of the sensors such that when traffic is coming from the direction being monitored by that specific sensor, that display is activated. As with the system in FIG. 2, the displays are both visible to traffic coming from a specific direction.

Figure 4:
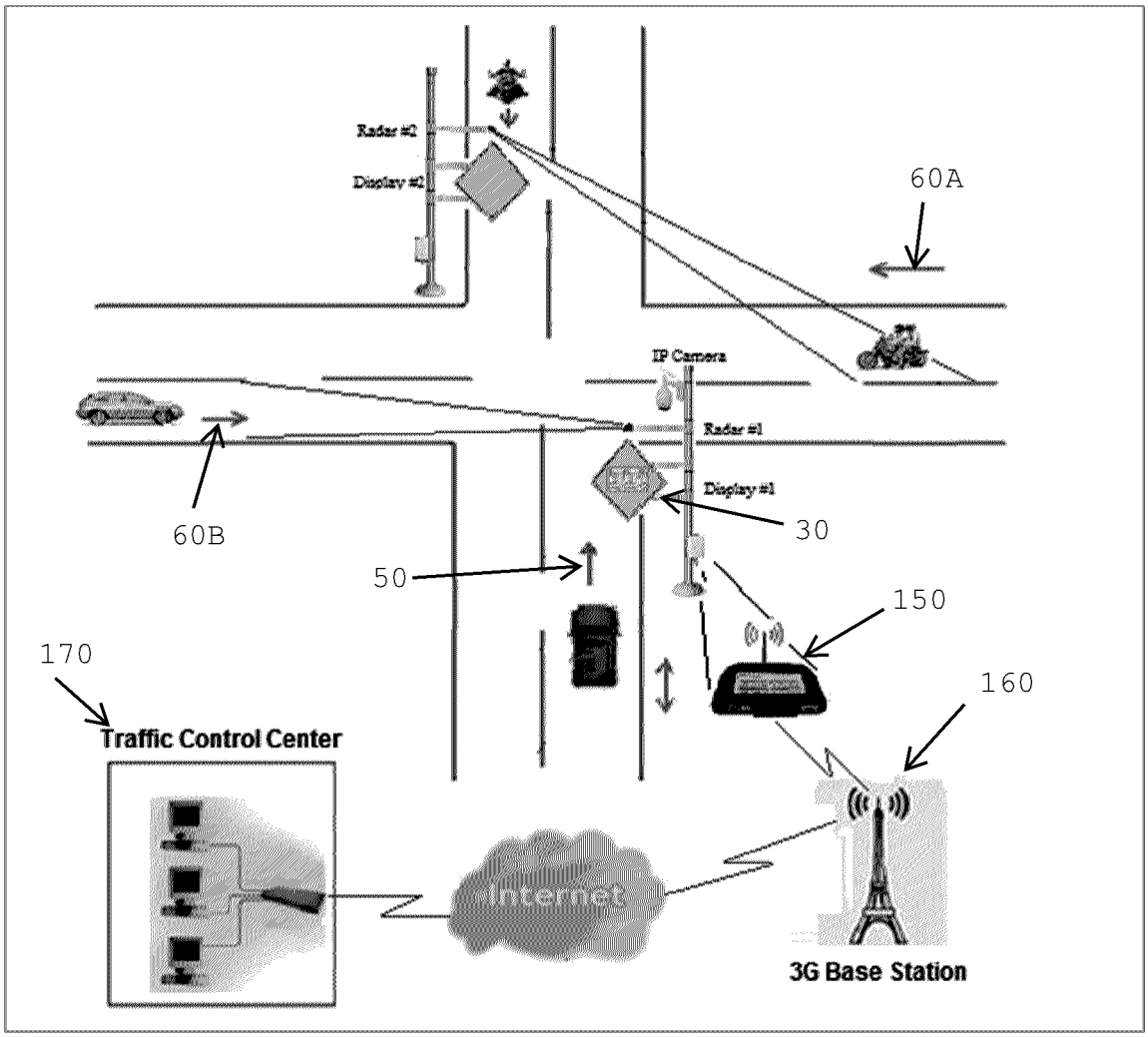
FIG. 4 is a diagram of a 4-way intersection used to explain a functioning of the system illustrated in FIG. 3.

Referring to FIG. 4, a diagram similar to FIG. 2 is illustrated. As can be seen, FIG. 4 shows a 4-way intersection with a display 30 visible to traffic coming from direction 50. Sensors detect incoming traffic from directions 60A, 60B. As with the other implementations, the display is activated when incoming traffic from the relevant directions are detected. Of course, for this implementation, the display 30 has two sections, each of which is separately activatable, depending on the incoming traffic.

It should be clear that although FIGS. 2-4 illustrate vehicular traffic as being monitored by the sensors of the system, foot traffic may also be monitored by the system. While vehicular traffic may be important to a viewer in a vehicle, warnings about incoming foot traffic are also useful for the safety of both the vehicle and the individuals who make up the foot traffic. Of course, if foot traffic is to be monitored by the system, adjustments may be made to the sensors and to the programming of the system to account for the difference in speed and potential volume between foot traffic and vehicular traffic.

Figure 5A:
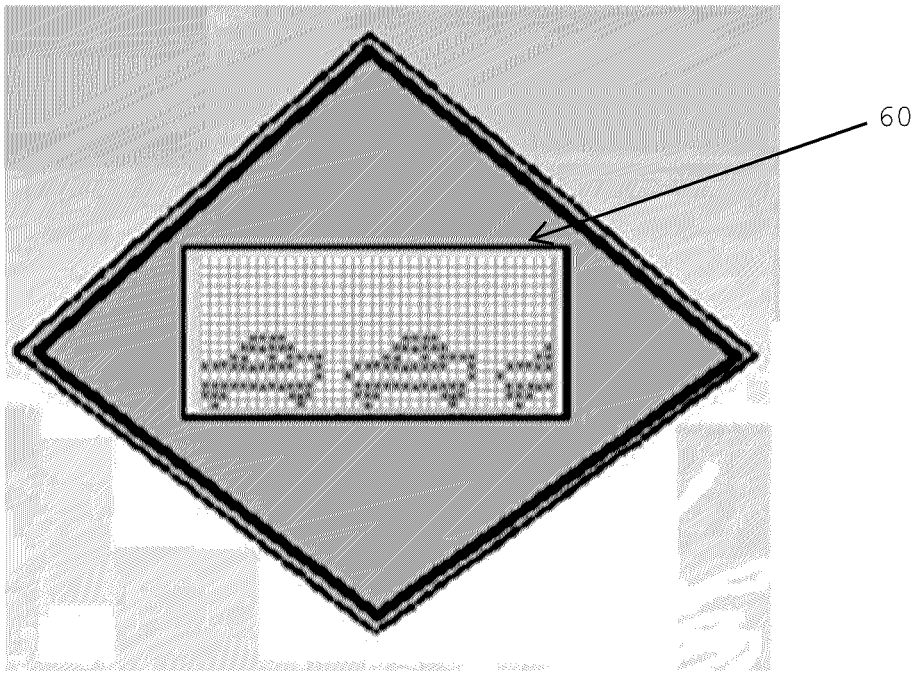
FIG. 5A illustrates one implementation of a display according to one aspect of the invention.

Referring to FIG. 5A, display 60 is shown. The display illustrates a single line of cars and is usable for an intersection where traffic is only coming from a single direction. As can be seen, the cars on the display are facing left in FIG. 5A. When deployed, the display would indicate incoming traffic from a specific direction. In one implementation, the cars are animated on the display to give the viewer the impression that one or more cars are traversing the display from one side to the other.

Figure 5B:
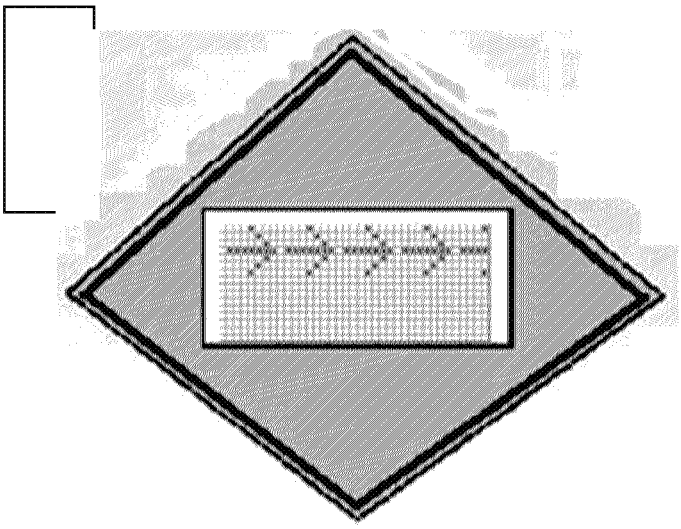
FIG. 5B illustrates a variant of the display illustrated in FIG. 5A.

Referring to FIG. 5B, a variant of the display 60 is illustrated. As can be seen, instead of a line of cars, arrows are displayed on display 60 to indicate to a viewer a direction of travel for incoming traffic.

Figure 6A:
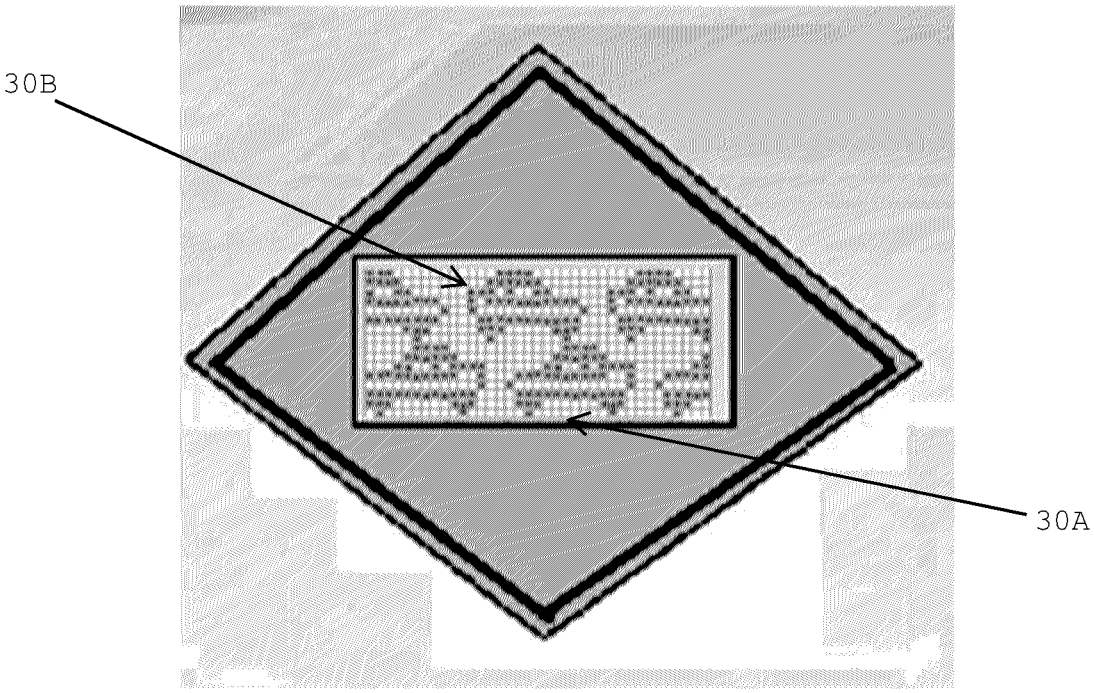
FIG. 6A is a dual display variant of the display illustrated in FIG. 5A.

Referring to FIG. 6A, a dual display for use with the system in FIG. 3 is illustrated. As can be seen, display 30A has cars moving from right to left while display 30B has cars moving in the opposite direction. As can be imagined, the display 30A is controlled by a sensor monitoring incoming traffic from one direction while display 30B is controlled by another sensor which monitors incoming traffic from another direction.

Figure 6B:
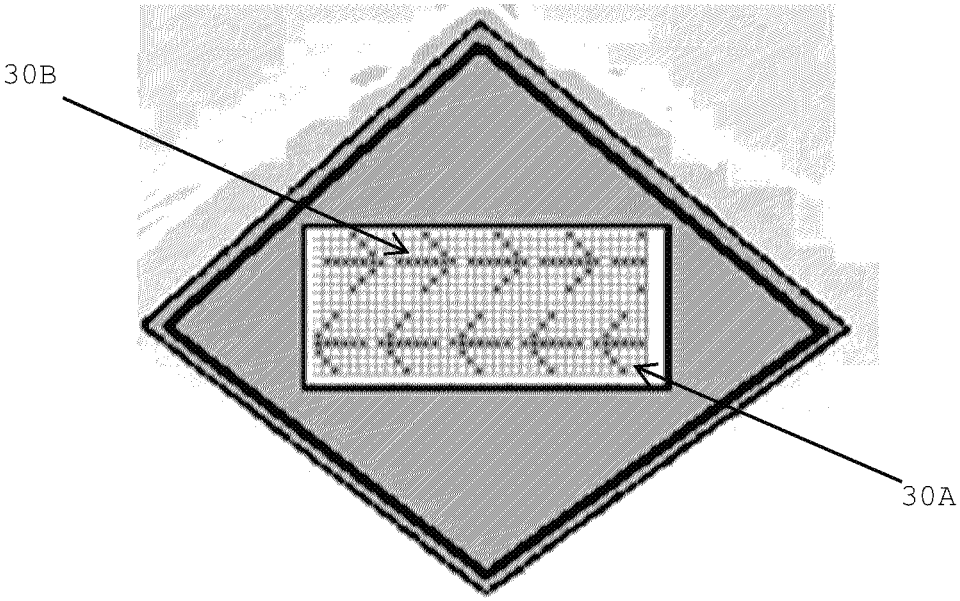
FIG. 6B is a dual display variant of the display illustrated in FIG. 5B.

Referring to FIG. 6B, a variant of the display in FIG. 6A is illustrated. Much like FIG. 5B, instead of lines of cars, two sets of arrows are displayed on the dual display. In display 30A, arrows directing from left to right indicate a direction of travel for incoming traffic while the arrows in display 30B indicate that incoming traffic travelling in the opposite direction is also present.

Regarding the sensors, any sensor capable of detecting incoming traffic may be used. These sensors may be attached to the display or they may be installed remotely from the display. Examples of remotely installed sensors include sensors that are installed in the roadway and may include inductive loop detectors, weigh-in-motion sensors, magnetometers, tape switches, microloops, pneumatic road tubes, and piezoelectric cables. Other remotely installed sensors include those that are for installation adjacent to or above the roadway. Such sensors include video image processors, microwave radar sensors, ultrasonic sensors, passive infrared sensors, laser radar sensors, and passive acoustic sensors. In one implementation, Doppler-based sensors (using microwave radar) and/or LIDAR-based sensors were used.

It should also be noted that, for some implementations, pole mounted sensors and/or displays may be used to avoid costly and time consuming modifications to the roadway. As well, pole mounted sensors and/or displays may be easier to deploy than implementations involving systems with in-ground components.

In another implementation, the sensors and the data processing components can be configured to filter incoming data. As an example, some microwave radar or LIDAR-based sensors are able to determine the velocity of detected objects. A velocity based filter can be used to filter out irrelevant objects. In one example, objects travelling slower than 20 km/h can be filtered out as irrelevant. A driver of a vehicle coming to an intersection should be able to detect/see an incoming vehicle traveling at a speed of 20 km/h or less. Such a driver would have enough time to stop at the intersection and, as such, the display would be unnecessary to warn the driver. Such a velocity threshold setting would also have the added advantage of filtering our pedestrian or foot traffic.

From the above, it should also be clear that the use of a velocity threshold has the added advantage of filtering out data regarding objects moving away from the sensor. As an object moving away from the sensor would have a negative velocity (i.e. since objects traveling towards the sensor would have a positive velocity, then objects moving away from the sensor would have a negative velocity), objects moving away from the sensor would be filtered out and would not be considered when determining whether or not to activate the display.

Returning to FIGS. 6A and 6B, it should be noted that, while the display 30A, 30B use the image of an automobile, other images may be used for the display. As examples, arrows, chevrons, and other symbols that indicate a direction or a direction of travel may be used. To assist someone viewing the display to understand the information being conveyed, the display may be animated such that the symbols on the display move or are displayed so that they give the appearance of movement from left to right or from right to left as necessary. A display with symbols moving from left to right would indicate to a viewer that traffic from the left of the viewer is approaching while a display with symbols moving from right to left would indicate that traffic from the right of the viewer is approaching.

The display may use any suitable technology that enables presenting the above noted symbols to a viewer. As such, the display may use an array of LEDs (light emitting diodes), an illuminated LCD display, or any array of suitable light bulbs or light producing devices. Similarly, the display may simply be a series of suitably arranged LEDs or bulbs that are activated in sequence to give the viewer the appearance of movement from one direction to another. In yet another variant, a non-directional indicator, such as a strobe light mounted atop a stop sign, may be used. However, an indication detailing a direction of travel for the incoming traffic is preferred.

The main control module may be any suitable circuit capable of logical or pseudo-logical operations. As such, any combinational circuit or any processor-based circuit, with suitable programming, may be used as the main control module. An ASIC (application specific integrated circuit) may also be used as a main control module.

In one variant of the invention, a main control module is not used as the sensor is part of an autonomous sensor module and the display is part of an autonomous display module. For this variant, each sensor module senses incoming traffic from a specific direction and, when incoming traffic is detected, the sensor module broadcasts a specific signal. Each display module can be configured to receive signals from any specific sensor module. Once a display module receives a signal from a specific sensor module, that display module is activated. The display module can then display a warning about the incoming traffic. It should be clear that, depending on the configuration, a display module can be configured to receive signals from one or more sensor modules to thereby activate its display. Of course, a display module can be configured to receive signals from only one specific sensor module such that the display module is only activated when incoming traffic from one specific direction is detected.

Regarding the above noted display module, it should be noted that, in one implementation, each display module is only activated for a set amount of time when an incoming vehicle or traffic is detected. Thus, in an initial state, the display controlled by the display module is in an inactive or dormant state. Once the display module detects an activation signal from a specific sensor module, the display is activated for a specific amount of time with a timer controlling how long the display is active. Once the time on the timer has expired, the display is deactivated or is rendered dormant. Of course, if the display module receives another signal from the specific sensor module while the timer is counting down, the timer is reset to its preset countdown value and the countdown restarts. Thus, as an example, if the display module receives an activation signal (i.e. a signal that incoming traffic from a specific direction has been detected by a specific sensor module), the display is activated with a countdown from a preset time, e.g. 1 minute. If, at the 30 second mark during the countdown, the display module receives another signal from the same sensor module indicating that another vehicle is incoming, then the timer is reset to 1 minute and the countdown begins anew. Once the timer is allowed to finish its countdown (i.e. no new incoming traffic has been detected by the specific sensor module and the timer is not reset), then the display is deactivated or rendered dormant.

Figure 6C:
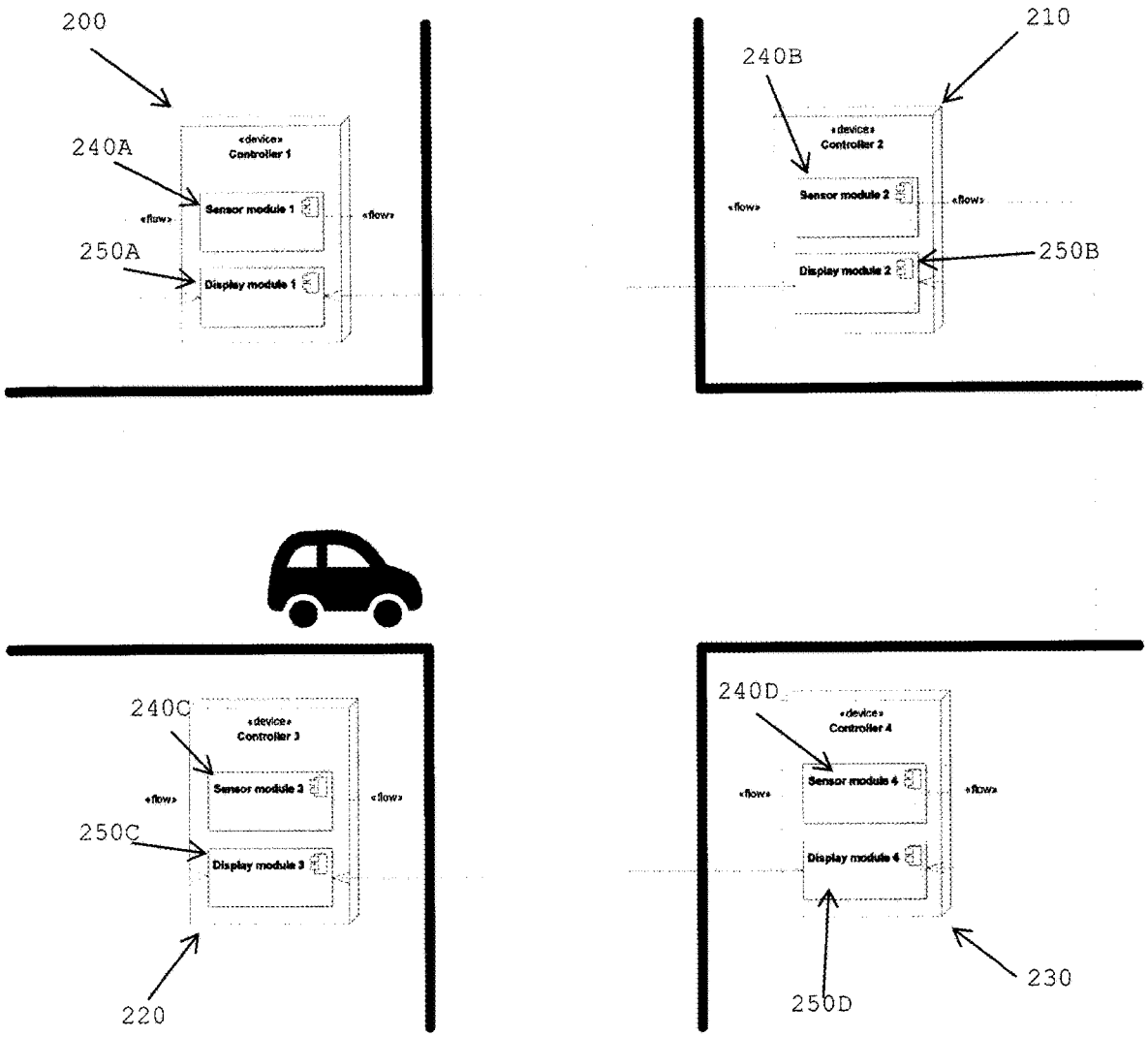
FIG. 6C is a diagram illustrating a 4-way intersection illustrating a variant of the system of the invention.

It should also be noted that the variant noted above is configurable for whatever intersection or configuration is desired. Referring to FIG. 6C, a diagram of a four-way intersection using this variant is illustrated. In the figure, four devices 200, 210, 220, 230 are illustrated with each device having a sensor module and a display module. As can be seen, device 200 has sensor module 240A and display module 250A while device 210 has sensor module 240B and display module 250B. Similarly, device 220 has sensor module 240C and display module 250C with device 230 having sensor module 240D and display module 250D. As noted above, each sensor module broadcasts activation signals whenever incoming traffic from a specific direction is detected. Also as described above, each display module is configured to receive activation signals from at least one specific sensor module. It should be clear that a display module is not necessarily configured to receive activation signals from the sensor module within the same device, e.g. display module 250C is not necessarily configured to receive activation signals from sensor module 240C.

In operation, the system in FIG. 6C has each of its sensor modules detecting incoming traffic from its side of the road. For jurisdictions which drive on the right side of the road, sensor module 240C would detect incoming traffic coming from the left of the figure. Sensor module 240D would detect incoming traffic coming from the bottom of the figure while sensor module 240B would detect incoming traffic coming from the right of the figure. Sensor module 240A would detect incoming traffic coming from the top of the figure. Similarly, each display module would be used to display warnings to traffic on its side of the road (for jurisdictions driving on the right side of the road). Thus, display module 250D would be displaying warnings for motorists coming from the bottom of the figure and display module 250B would display warnings for motorists coming from the right side of the figure. Display module 250A would display warnings for motorists coming from the top of the figure and display module 250C would display warnings for motorists coming from the bottom of the figure.

It should be clear that, for the system in FIG. 6C, each display module receives activation signals from two specific sensor modules. Since each motorist approaching the intersection will need to be warned about potential incoming traffic from two directions, sensor modules monitoring each of these two directions will need to be able to activate the relevant display module. From the figure, it can be seen that display module 250D receives activation signals from sensor modules 240C and 240B. As well, each of the other display modules receives activation signals from the two sensor modules adjacent (but not across from it) to it but not from the sensor module on the same device. This arrangement can be implemented by use of a suitable Wi-Fi network where each sensor module broadcasts its activation signals via a specific wireless (e.g. Wi-Fi) network. Each display module is a member of the wireless network and can determine which activation signals to receive/be activated by. The use of a wireless network allows for quick setup of the system and removes the need for road modifications. Of course, for such an implementation, the wireless network would need to be properly secured to prevent unauthorized tampering.

Figure 7:
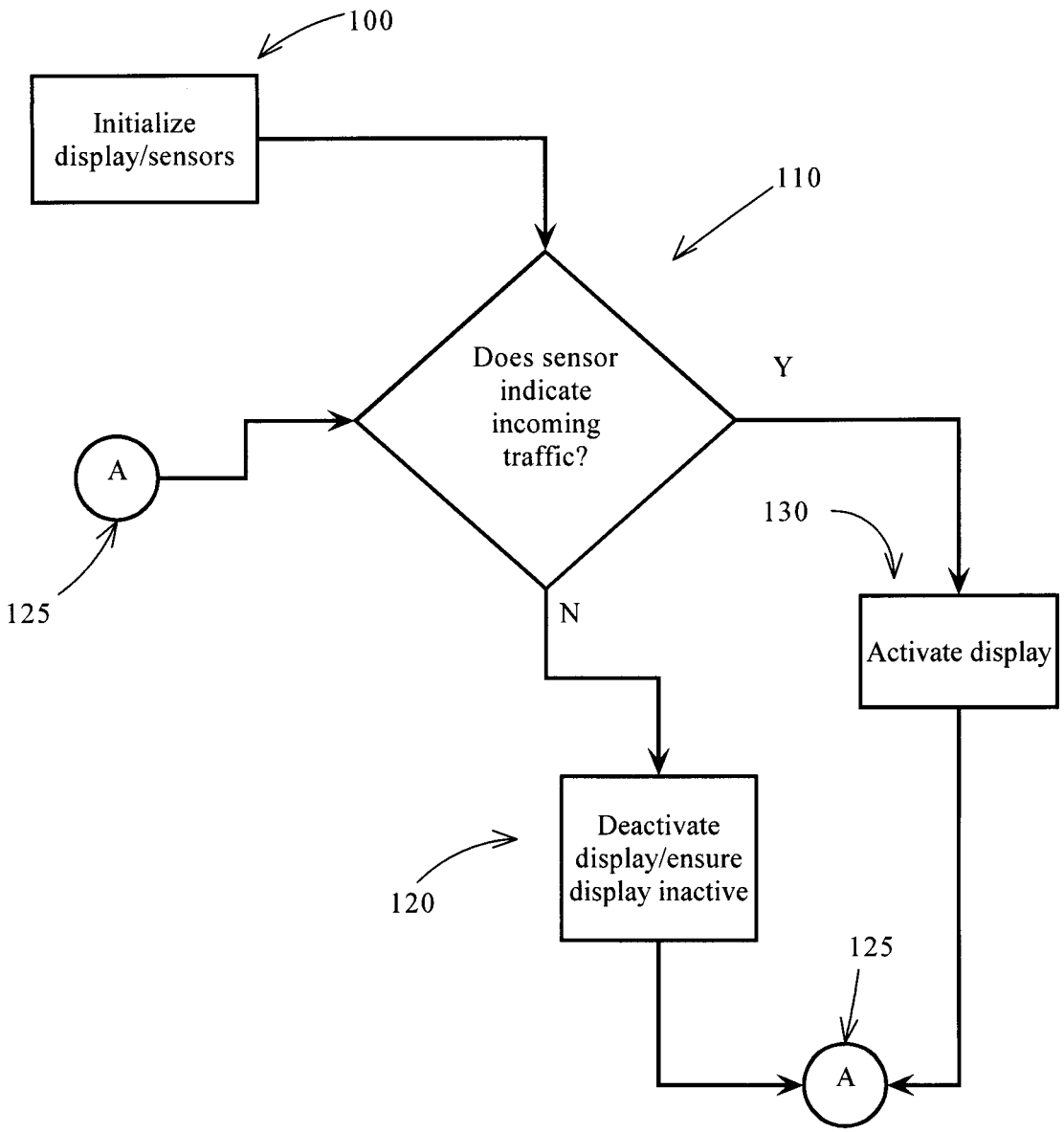
FIG. 7 is a flowchart illustrating a method according to another aspect of the invention.

The logic controlling the main control module may be represented by the flowchart illustrated in FIG. 7. As can be seen in FIG. 7, the initial step is that of initializing the display and the sensors (step 100). Once initialized, the sensors are then checked continuously for incoming traffic (decision 110). If no incoming traffic from the relevant direction is detected, the display is turned off or the control module ensures that the display is not active (step 120). The logic then loops to continuously check the sensor readings (connector 125). Once incoming traffic is detected, the display is activated (step 130). After activation of the display, the logic flow returns to check the sensor if incoming traffic is detected. Of course, once incoming traffic has passed the sensor's region of detection (i.e. the region in which the sensor can detect incoming traffic), the logic flow ensures that the display is deactivated (i.e. turned off).

It should be clear that the logic depicted in the flowchart of FIG. 7 only applies to a single sensor monitoring traffic incoming from a single direction. For a system that uses two different sensors to monitor different directions, each sensor/display combination would be independently controlled by the main control module executing the logic illustrated in FIG. 7. As such, for a system with two sensor/display combinations, a single main control module would execute two instances of the logic and would execute these instances in parallel. Of course, the system may also use separate main control modules for each sensor/display combination.

For the implementation illustrated in FIG. 6C, the method shown in FIG. 7 would be implemented between each sensor module and each display module. Step 110 would be implemented by each sensor module and step 130, for each sensor module, would be to broadcast an activation signal. For each display module, step 110 would be whether an activation signal has been received or not. As well, for each display module, in addition to activating the display, step 130 would include starting or restarting a timer. The timer would be continuously monitored and, once the timer's countdown has elapsed, then step 120 is executed by the display module. Alternatively, the timer could be set so that an interrupt that deactivates (or renders dormant) the display is generated when the timer's countdown has elapsed.

As another possible step in the method outlined in FIG. 7, the system may log each and every time the display is activated. This can include logging the time, date, and length of time that the display is active. The data gathered can then be uploaded from the system to the central traffic base station at specific intervals.

In another implementation of the system, the system may include further circuitry to log and report the incoming traffic to a central traffic base station. Thus, every time one or both displays are activated (for a system with dual displays), an entry is logged along with the direction that the incoming traffic is coming from. The resulting logs are then communicated to the central traffic base station for statistical analysis.

It should be noted that, in one specific implementation of the system, LIDAR is used as the sensor with the LIDAR subsystem being placed adjacent a red 16×32 LED display. An auxiliary display, consisting of at least two LED strobe/flashing lights, is provided in the event of a power failure and in the event the main display is unable to be activated. Of course, a battery backup subsystem is attached to provide power to the auxiliary display and to the main control module in the event of a power outage. In addition to the above, a digital camera, along with a network communications module, also forms part of the system. The network communications module may be used to communicate with the central traffic base station using an IP based network.

For the above implementation, a message is generated every time the LIDAR sensor detects incoming traffic. After the main display has been activated, the generated message is transmitted by the system to the central traffic base station. The digital camera may, depending on the configuration, also be activated whenever the main display is active. For better monitoring, the central traffic base station may exercise direct control over the activation/deactivation of the digital camera.

To ensure that the system is in working condition, the system may be configured to send periodic messages to the central traffic base station even if no incoming traffic has been detected. This ensures that the central traffic base station can monitor the condition of the system. If no messages have been received from the system after a given period of time, an alarm is triggered at the central traffic base station.

For clarity, it should be clear that the implementation noted above is illustrated in FIG. 4. In this implementation, the logs gathered by the system are transmitted by way of a wireless communications module 150 to a remote base station 160. The logs are then transmitted from the base station 160 to the central traffic control center 170 through the Internet. Control of the digital camera also travels from the control center to the system through this same route.

It can also be seen from FIG. 4 that the system has two displays with one display being viewable by motorists coming from direction 50. The other display is viewable by motorists coming from the direction opposite to direction 50. These two displays, each deployed at a separate pole at opposite sides of the intersection, are coordinated and are both controlled by a single main control module. These two displays can be controlled by the main control module using wired or wireless communications between the two pole installations. Preferably, as illustrated in FIG. 4, sensors are placed at each of the two poles holding the displays. One set of sensors can monitor traffic coming from direction 60A while another set of sensors can monitor traffic coming from direction 60B. Of course, traffic detected by either of the sensors can be logged along with the activation/deactivation cycles of the displays.

The embodiments of the invention may be executed by a computer processor or similar device programmed in the manner of method steps, or may be executed by an electronic system which is provided with means for executing these steps. Similarly, an electronic memory means such as computer diskettes, CD-ROMs, Random Access Memory (RAM), Read Only Memory (ROM) or similar computer software storage media known in the art, may be programmed to execute such method steps. As well, electronic signals representing these method steps may also be transmitted via a communication network.

Embodiments of the invention may be implemented in any conventional computer programming language. For example, preferred embodiments may be implemented in a procedural programming language (e.g. "C") or an object-oriented language (e.g. "C++", "java", "PHP", "PYTHON" or "C#"). Alternative embodiments of the invention may be implemented as pre-programmed hardware elements, other related components, or as a combination of hardware and software components.

Embodiments can be implemented as a computer program product for use with a computer system. Such implementations may include a series of computer instructions fixed either on a tangible medium, such as a computer readable medium (e.g., a diskette, CD-ROM, ROM, or fixed disk) or transmittable to a computer system, via a modem or other interface device, such as a communications adapter connected to a network over a medium. The medium may be either a tangible medium (e.g., optical or electrical communications lines) or a medium implemented with wireless techniques (e.g., microwave, infrared or other transmission techniques). The series of computer instructions embodies all or part of the functionality previously described herein. Those skilled in the art should appreciate that such computer instructions can be written in a number of programming languages for use with many computer architectures or operating systems. Furthermore, such instructions may be stored in any memory device, such as semiconductor, magnetic, optical or other memory devices, and may be transmitted using any communications technology, such as optical, infrared, microwave, or other transmission technologies. It is expected that such a computer program product may be distributed as a removable medium with accompanying printed or electronic documentation (e.g., shrink-wrapped software), preloaded with a computer system (e.g., on system ROM or fixed disk), or distributed from a server over a network (e.g., the Internet or World Wide Web). Of course, some embodiments of the invention may be implemented as a combination of both software (e.g., a computer program product) and hardware. Still other embodiments of the invention may be implemented as entirely hardware, or entirely software (e.g., a computer program product).

A person understanding this invention may now conceive of alternative structures and embodiments or variations of the above all of which are intended to fall within the scope of the invention as defined in the claims that follow.

We claim:

1. A traffic notification system comprising:

at least one activatable display, said display being visible to first incoming traffic travelling from a first direction;

at least one sensor for sensing second incoming traffic travelling from a second direction;

wherein said first direction is different from said second direction;

said at least one display activates based on a first signal received directly from said at least one sensor when second incoming traffic is sensed by said at least one sensor;

said at least one display also activates based on a second signal received directly from at least one other sensor, said at least one other sensor being a stationary sensor located near said at least one display and said at least one other sensor being for sensing third incoming traffic from a third direction, said third direction being different from said second direction;

said at least one display only activates in response to either of said first signal or said second signal;

when said at least one display is activated, said display provides a visual warning to said first incoming traffic that said second incoming traffic or said third incoming traffic is present;

said display comprises at least one indicator that indicates a direction of travel of said second incoming traffic or said third incoming traffic; and said at least one sensor is a fixed installation.

2. The system according to claim 1, wherein said first direction is at right angles to said second direction.

3. The system according to claim 1, wherein, when activated, said at least one display displays an animation.

4. The system according to claim 1, wherein said first incoming traffic, said second incoming traffic, and said third incoming traffic each comprises at least one of: bicycle traffic, pedestrian or foot traffic, or motorized vehicular traffic.

5. The system according to claim 1, further comprising a module for transmitting reports to a central traffic station.

6. A method for controlling a traffic notification system, the system having at least one activatable display visible by first incoming traffic travelling from a first direction, and having at least one sensor for sensing second incoming traffic travelling from at least one second specific direction and having at least one other sensor for sensing third incoming traffic from a third direction, said at least one other sensor being a stationary sensor located near said activatable display, the method comprising:

(a) ensuring that said at least one display is inactive and that at least one of said at least one sensor or said at least one other sensor is active;

(b) determining if said at least one sensor senses said second incoming traffic;

(c) in the event said at least one sensor senses said second incoming traffic, activating said at least one activatable display based on a first signal sent directly to said activatable display from said at least one sensor;

(d) determining if said at least one other sensor senses said third incoming traffic;

(e) in the event said at least one other sensor senses said third incoming traffic, activating said at least one activatable display based on a second signal sent directly to said activatable display from said at least one other sensor;

(f) in the event said activatable display is active, said at least one sensor does not sense said second incoming traffic, and said at least one other sensor does not sense said third incoming traffic, deactivating said at least one activatable display, wherein said activatable display, when activated, displays at least one indicator that indicates a direction of travel of said second incoming traffic or said third incoming traffic and wherein said at least one sensor is a fixed installation, wherein said third direction is different from said second direction and wherein said activatable display is only activated in response to either of said first signal or said second signal.

7. The method according to claim 6, further comprising a step of recording in a log whenever said at least one activatable display is activated.

8. The method according to claim 7, wherein said log is uploaded at periodic intervals to a central traffic base station.

9. The system according to claim 1, further including a velocity based filter to filter out pedestrian or foot traffic.

10. The method according to claim 6, further including filtering out pedestrian or foot traffic by way of a velocity based filter.

11. The system according to claim 1, wherein said indicator is displayed for a predetermined time interval.

12. The method according to claim 6, wherein said indicator is displayed for a predetermined time interval.

* * * * *